United States Patent [19]

Crean et al.

[11] Patent Number: 4,652,161

[45] Date of Patent: Mar. 24, 1987

[54] SHEET FEEDING APPARATUS

[75] Inventors: Gerald J. Crean, Topsfield; Roger R. Soulard, Dracut, both of Mass.

[73] Assignee: Wang Laboratories, Inc., Lowell, Mass.

[21] Appl. No.: 734,422

[22] Filed: May 15, 1985

Related U.S. Application Data

[63] Continuation of Ser. No. 489,338, Apr. 28, 1983, abandoned.

[51] Int. Cl.[4] ..... B41J 13/10

[52] U.S. Cl. ..... 400/625; 400/551; 400/629; 271/10

[58] Field of Search ..... 271/DIG. 9, 10, 65, 271/186; 400/551, 568, 624, 625, 629

[56] References Cited

U.S. PATENT DOCUMENTS

| | | | |
|---|---|---|---|
| 3,047,290 | 7/1962 | Thomsen | 271/125 |
| 3,430,748 | 3/1969 | Parri | 400/625 |
| 3,744,789 | 7/1973 | Kolibas | 271/42 |
| 3,776,545 | 12/1973 | White | 271/4 |
| 4,039,180 | 8/1977 | Stocker | 271/10 |
| 4,089,402 | 5/1978 | Hyland et al. | 400/629 |
| 4,113,244 | 9/1978 | Ruenzi | 271/186 |
| 4,236,709 | 12/1980 | Hunt | 271/21 |
| 4,248,415 | 2/1981 | Steinhilber | 271/9 |
| 4,266,880 | 5/1981 | Buchanan | 400/568 |
| 4,268,021 | 5/1981 | Rutishauser et al. | 400/625 |
| 4,372,699 | 2/1983 | Quinn, Jr. | 400/625 |
| 4,386,864 | 6/1983 | Wang et al. | 400/625 |
| 4,416,559 | 11/1983 | Steinhilber | 400/629 |

FOREIGN PATENT DOCUMENTS

| | | | |
|---|---|---|---|
| 1780 | 1/1982 | Japan | 400/629 |
| 61587 | 4/1982 | Japan | 400/629 |

OTHER PUBLICATIONS

Rachni, "Printer Paper Feed", IBM Technical Disclosure Bulletin, vol. 19, No. 10, pp. 3632–3633, 3/77.

Fitzgibbons et al., "Paper Takeup . . . ", IBM Technical Disclosure Bulletin, vol. 23, No. 5, pp. 2159–2160, 10/80.

*Primary Examiner*—William Pieprz

*Attorney, Agent, or Firm*—Michael H. Shanahan

[57] ABSTRACT

A paper feeder for use in dispensing paper into a printer with sensors for leading and trailing edges of paper and with a platen which rotates in a forward imprinting direction in response to a leading edge and in a backward, paper-ejecting direction in response to a trailing edge, the paper feeder comprising a paper holder, at least one rotatable drive roller to operably contact paper in the holder, and a drive train connecting the platen to the roller and controlled exclusively by such connection to cause no roller rotation in response to forward platen rotation, and to cause roller rotation in a paper-dispensing direction in response to backward platen rotation; the drive train is arranged so that the roller delivers paper to a paper-loading position on the printer not before the platen completes paper ejection; whereby backwards platen rotation provides simultaneous paper ejection and dispensing.

2 Claims, 3 Drawing Figures

SHEET FEEDING APPARATUS

This is a continuation of application Ser. No. 489,338, filed Apr. 28, 1983, now abandoned.

BACKGROUND OF THE INVENTION

This invention relates to paper feeders for use on printers having sensors for sensing paper presence, forward imprinting platen rotation and backward paper-rejecting platen rotation.

Such a printer is described in U.S. Pat. No. 4,386,864, where controls are provided to cause forward platen rotation for first, feeding a sheet of paper from an upper hopper to a paper load position at the bottom of the platen and then printing the sheet, and to cause backwards platen rotation for ejecting the printed sheet downwardly toward a lower hopper for sequentially stacking the sheets of paper.

It is desirable to provide such printers with a paper feeder that can dispense unprinted sheets of paper to the printer.

SUMMARY OF THE INVENTION

In one aspect, the invention features a paper feeder for dispensing sheets of paper, one at a time, into a printer having sensors for sensing leading and trailing edges of sheets of paper. The printer has a platen which rotates in a forward imprinting direction in response to sensing a leading edge, and rotates in a backward, paper-ejecting direction in response to sensing a trailing edge. The feeder has a paper cartridge for holding a stack of paper and at least one rotatable drive roller to operably contact the topmost sheet of paper in the cartridge.

A drive train for connecting the platen to the drive roller is powered and controlled exclusively by its connection to the platen to cause no rotation of the drive roller in response to forward platen rotation, and to cause forward, paper-dispensing rotation of the drive roller in response to backward platen rotation. When the platen rotates backwards to eject a sheet of paper from the printer, the drive train causes the drive roller to move a sheet of paper from the cartridge into a paper-loading position on the printer, thus providing the printer with simultaneous paper ejection and dispensing.

The drive train is arranged so that the drive roller delivers sheets of paper to the paper-loading position not before the platen ejects the printed sheet of paper. In preferred embodiments, the drive roller rotates at a velocity slower than the rotational velocity of the platen. In the illustrated embodiment, the ratio of platen rotation to drive roller rotation is approximately 2:1. In other embodiments, the drive train is arranged to cause the feeder to dispense sheets of paper over a greater distance than the maximum length of paper being ejected.

Therefore, the printer is provided with simultaneous paper ejection and dispensing, and the drive train provides that sheets of paper are not delivered to the paper-loading position before the platen ejects the printed sheet of paper.

In other aspects of the invention, the invention feature a printer having sensors for sensing leading and trailing edges of sheets of paper, control means for controlling platen rotation in response to the sensing, a paper feeder arranged to dispense sheets of paper, and a drive train for connecting the paper feeder to a platen. The control means are responsive to sensing a leading edge and completion of paper ejection, causing the platen to rotate in a forward imprinting direction. The control means provide simultaneous paper ejection from and paper feeding into the printer solely through sensing a trailing edge and causing the platen to rotate a predetermined amount first in a forward imprinting direction and second in a backward paper-ejecting direction. The drive train responds solely to backward, paper-ejecting platen rotation to dispense a sheet of paper from the feeder, and is arranged so that the paper feeder delivers sheets of paper to a paper-loading position on the printer not before the platen ejects the printed sheet of paper.

In still further aspects of the invention, the invention feature a printer having sensors for sensing the presence of a sheet of paper, a paper feeder, a drive train, and programmed control means which provide simultaneous paper ejection from and paper feeding into the printer solely through controlling rotation of the platen in response to sensing paper presence. The drive train responds solely to paper-ejecting platen rotation to dispense a sheet of paper from the feeder, and is arranged so that the feeder delivers sheets of paper to a paper-loading position on the printer not before the platen ejects the printed sheet of paper.

In preferred embodiments, the programmed control means respond to sensing no paper at start-up of the printer, by causing the platen to rotate a predetermined amount in a paper-ejecting direction, which causes the feeder to dispense a sheet of paper. The control means respond to a trailing edge, causing the platen to rotate a predetermined amount first in a paper-imprinting direction and second in a paper-ejecting direction. At the completion of paper ejection, the control means respond to a leading edge, causing the platen to rotate in a forward paper-imprinting direction, and respond to sensing no paper, causing the printer to stop.

Also in preferred embodiments, the paper feeder is releasably attached to the printer and has disengaging means for disengaging, without removing, the paper feeder from the printer by eliminating operable contact between the stack of paper and the drive roller. In the illustrated embodiment, a pusher plate biased against the stack of paper in the cartridge provides the operable contact, and manipulation of a select knob, connected to a pusher rod, causes the pusher rod to move the pusher plate away from the stack, thereby eliminating the operable contact.

Other advantages and features of the invention will be apparent from the following description of the preferred embodiment thereof, and from the claims.

DESCRIPTION OF THE PREFERRED EMBODIMENT

We turn now to the structure and operation of the preferred embodiment first briefly describing the drawings thereof.

DRAWINGS

DESCRIPTION

Figure 1:
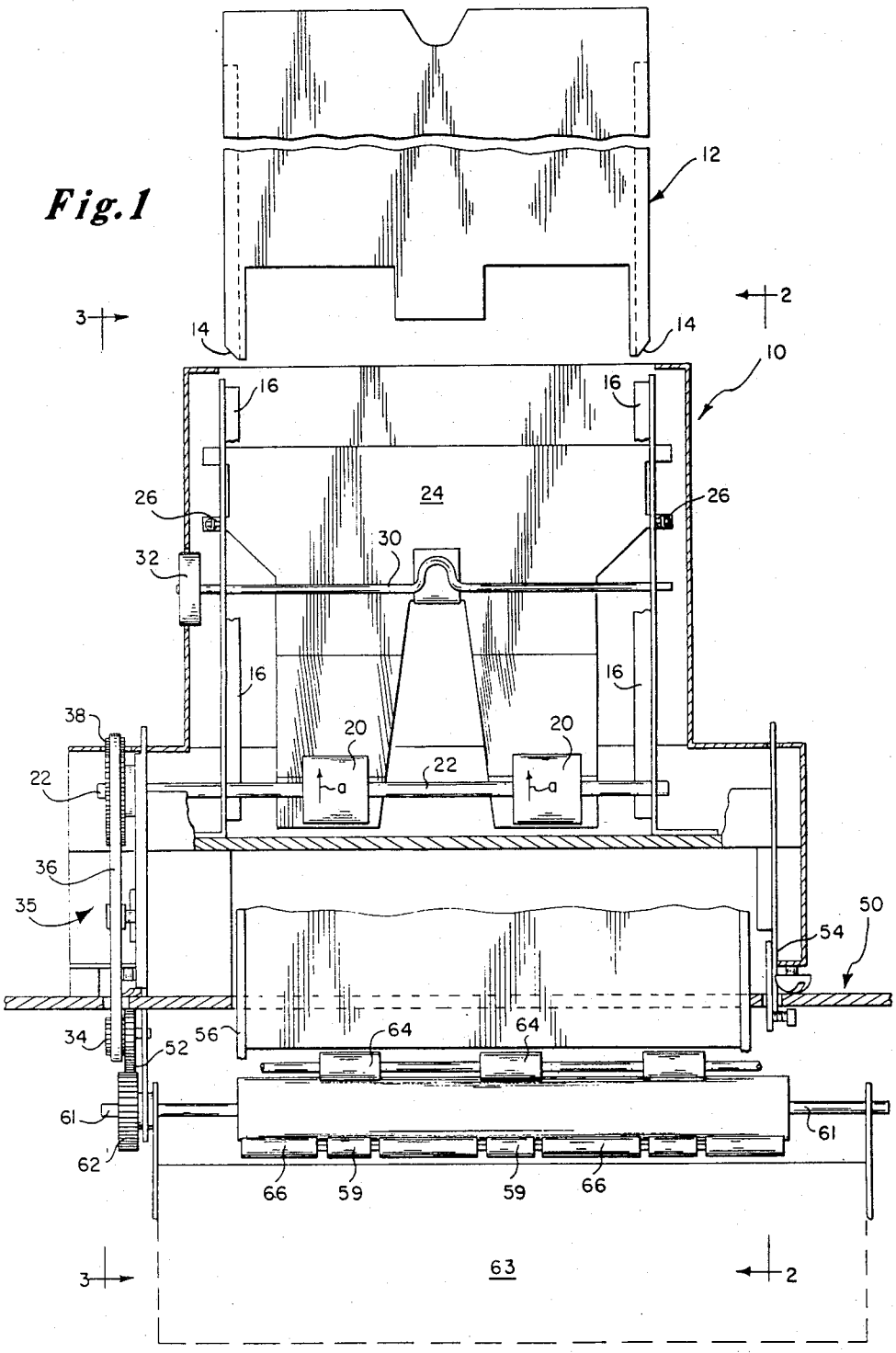
FIG. 1 is an exploded view of the preferred embodiment of the invention, with parts broken away for clarity.
Figure 2:
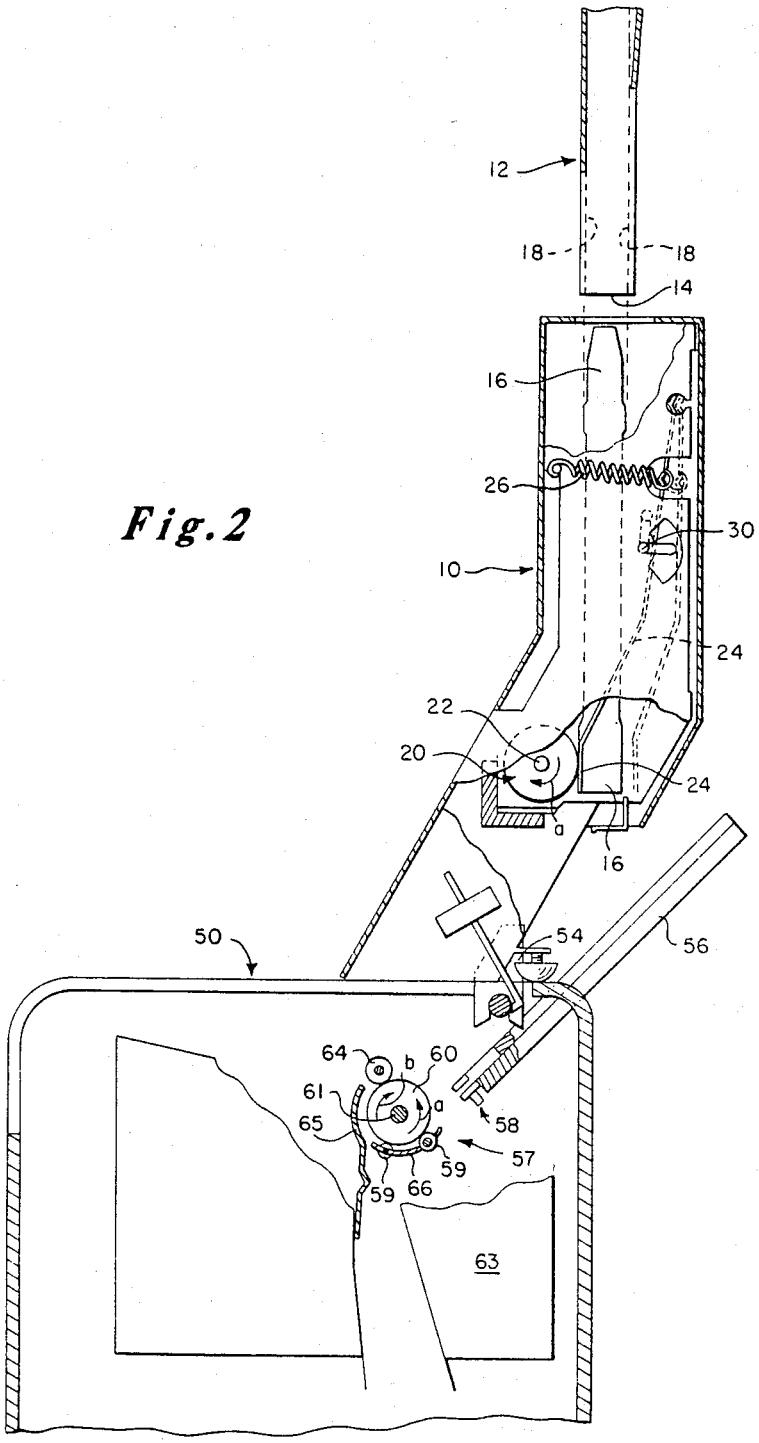
FIG. 2 is a side view of FIG. 1, with parts broken away for clarity.
Figure 3:
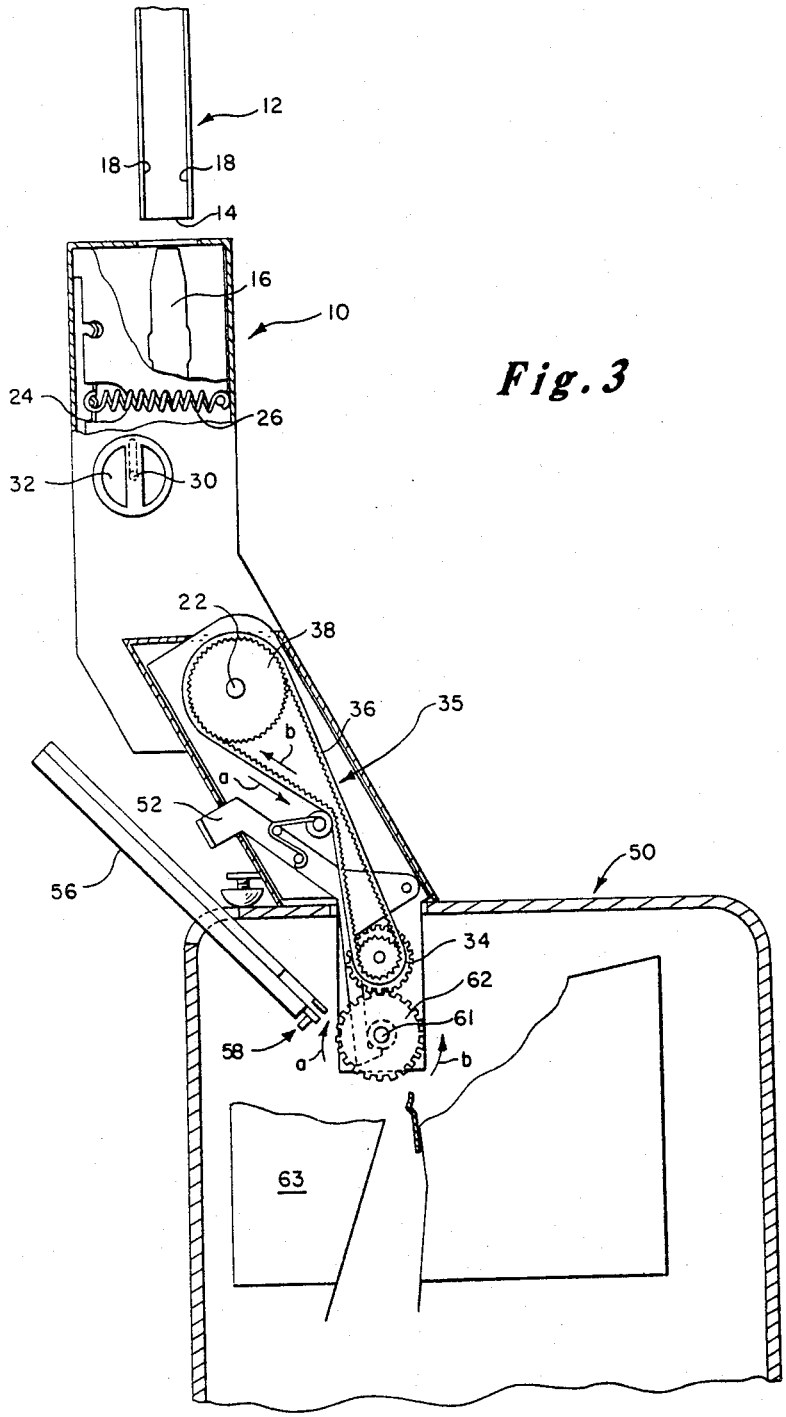
FIG. 3 is the opposite side view of FIG. 1, with parts broken away for clarity.

As seen in FIGS. 2 and 3, a paper feeder 10 is attached to one side of printer 50 by spring clip 52, and to the opposite side of machine 50 by catch 54.

Components of printer 50 include platen 60 fixedly mounted on platen shaft 61, and paper-loading guide 56 to guide the unprinted sheet of paper to the loading position of platen 60 at the edge of the lower platen feed roll and guide mechanism 57. An optical sensor 58 mounted on guide 56 is provided to sense the leading and trailing edges of paper, and platen controls 63 are provided to control the amount and direction of platen rotation in response to signals from sensor 58.

Lower platen feed roll and guide mechanism 57 includes an arcuate platen feed guide 66 provided under platen 60 and arranged to be biased so that plurality of platen guide rollers 59 rotatably mounted on feed guide 66 normally contact platen 60. A printed sheet deflection guide 65 is provided to guide printed paper around platen 60 and between platen 60 and printed sheet rollers 64 mounted coaxially with and normally contacting platen 60.

To understand the arrangement of the printer to which the feeder is attached, a short explanation of paper feeding, printing and ejection follows. As a leading edge of an unprinted sheet of paper is sensed by sensor 58, platen controls 63 cause platen 60 to rotate in a forward direction one quarter of a revolution to bring the sheet to the loading position of the platen at the edge of mechanism 57. Platen controls 63 continue to cause forward platen rotation so as to print the sheet of paper, which is pulled around platen 60 by platen guide rollers 59 which are biased against platen 60. Printed sheet deflection guide 65 guides printed paper upward around platen 60 and between platen 60 and printed sheet rollers 64.

When a trailing edge of a sheet of paper is sensed by sensor 58, controls 63 again cause platen 60 to rotate in a forward direction one quarter of a revolution to bring the sheet out from under platen feed guide 66. Platen controls 63 then cause platen 60 to reverse direction to rotate backwards and eject the printed piece of paper. Printed sheet rollers 64 bear against platen 60 to aid in ejecting the printed paper, and printed sheet deflection guide 65 directs the printed sheet downward toward a lower hopper (not shown) under the platen.

The paper feeder 10 attached to printer 50 has a removable paper cartridge 12 in which a stack of paper is held. In the lower two corners of cartridge 12 are trippers 14 arranged to separate the topmost sheet in cartridge 12 from the rest of the stack so as to allow feeder 10 to efficiently dispense one sheet of paper at a time.

Along the interior vertical length of cartridge 12 are insert guides (not shown) arranged so that vertical cartridge inserts (not shown) can be inserted into cartridge 12, thus altering the width of cartridge 12 so that paper of different widths (i.e. 8, 8¼, 8½ inches) may be stacked in cartridge 12.

As seen in FIG. 2, cartridge 12 is supported within feeder 10 by cartridge runners 18 which extend along the vertical length of paper cartridge 12 and fit over cartridge guide 16 extending along the vertical interior length of feeder 10. Cartridge guide 16 is arranged on the interior wall of feeder 10 so that cartridge 12 is held between drive rollers 20 and pusher plate 24.

Drive rollers 20 are fixedly mounted on feeder drive shaft 22, which extends transversely across feeder 10, and pusher plate 24 in the back of feeder 10 is urged toward drive rollers 20 by spring 26 in order to provide operable contact between the topmost sheet of paper in cartridge 12 and drive rollers 20. Pusher rod 30, extending transversely across feeder 10 between pusher plate 24 and rollers 20 are arranged to move pusher plate 24 away from cartridge 12 so as to remove the operable contact between the paper in cartridge 12 and drive rollers 20.

Select knob 32, mounted to pusher rod 30 on the exterior of feeder 10, is arranged to move pusher rod 30 toward and away from pusher plate 24. In FIG. 2, the extreme positions of pusher plate 24 are shown; first, in solid lines, as causing operable contact between the stack of paper and drive rollers 20, and second, in phantom, as moved away from drive rollers 20, thus removing operable contact and stopping automatic feeding.

As also seen in FIG. 3, feeder drive rollers 20 are connected to platen 60 through drive train 35, a series of gears and pulleys. Fixedly mounted to platen shaft 61 is platen gear 62 which engages platen gear/pulley 34. Timing belt 36 is arranged to transfer rotation from platen gear/pulley 34 to one-way feeder pulley 38 with a one way clutch or equivalent mechanism which is mounted on the end of drive shaft 22.

One-way feeder pulley 38 is so constructed to engage with and rotate drive shaft 22 and rollers 20 when timing belt 36 moves counter-clockwise, shown as "a" in FIG. 3, and to rotate freely without engaging drive shaft 22 when timing belt 36 moves clockwise, as shown as "b" in FIG. 3.

Drive train 35 is arranged so that feeder drive rollers 20 rotate exclusively in response to specific directional rotation of platen 60, in a direction opposite to that of platen 60 and at a frequency proportional to the rotational frequency of platen 60. This arrangemant provides that the predetermined amount of backward platen rotation necessary to eject a printed sheet of paper of maximum length simultaneously causes automatic dispensing of an unprinted sheet of paper into the platen paper-loading position at a time not before completion of the printed sheet ejection or at least not before most of the printed sheet has been ejected.

In the illustrated embodiment, the rotational frequency of drive rollers 20 is smaller than the rotational frequency of platen 60; the platen/drive roller frequency ratio is approximately 2:1. In other embodiments, a drive train may be arranged so that the platen and drive rollers rotate with approximately equal frequencies, but that the paper feeder dispenses sheets of paper to the printer over a greater distance than the maximum length of paper being ejected.

Operation

When sheet feeder 10 is attached to printer 50 and select knob 32 is turned so that pusher rod 30 moves pusher plate 24 away from drive roller 20, automatic sheet feeding is not selected. Automatic sheet feeding is selected when knob 32 is turned to move pusher rod 30 away from pusher plate 24 so that plate 24, normally biased by spring 26 toward drive roller 20, presses the stack of paper within cartridge 12 against drive roller 20, thus providing operable contact between the topmost sheet of paper and drive rollers 20.

When automatic sheet feeding is selected and the printer is first turned on, platen controls 63 within printer 50 rotate platen 60 in a backward direction so as to cause an unprinted sheet of paper to be dispensed from feeder 10 onto paper-loading guide 56. As seen as "a" in FIG. 3, drive train 35 transfers the backward rotation of platen 60 into a counter-clockwise, paper-dispensing rotation of drive shaft 22 and rollers 20. Specifically, the backward rotation of platen 60 and platen shaft 61 causes clockwise rotation of platen gear 62, which engages gear/pulley 34 and rotates it in a counter-clockwise direction. Timing belt 36 transfers the counter-clockwise rotation of platen gear/pulley 34 to one-way feeder pulley 38, which causes drive shaft 22 and rollers 20 to rotate in a counter-clockwise, paper-dispensing direction, pushing a piece of paper down onto the printer's paper-loading guide 56.

When the leading edge of the unprinted sheet of paper is sensed on paper-loading guide 56 by sensor 58, platen controls 63 cause platen 60 to rotate in a forward direction one quarter of a revolution to bring the sheet to the loading position of platen 60. Platen controls 63 continue to cause forward platen rotation so as to print the sheet of paper. Platen guide rollers 59, bearing against platen 60, guide paper under and around platen 60, and printed sheet rollers 64, bearing against platen 60, grip printed paper that has passed around platen 60.

During paper printing, drive train 35 does not transfer the forward rotation of platen 60 to drive shaft 22 and rollers 20. Specifically, as seen as "b" in FIG. 3, the forward rotation of platen 60 and platen shaft 61 causes counter-clockwise rotation of platen platen gear 62 and clockwise rotation of gear/pulley 34. Timing belt 36 transfers the clockwise rotation to one-way feeder pulley 38, which rotates clockwise without turning drive shaft 22 and rollers 20.

Forward paper-imprinting platen rotation continues until sensor 58 senses the trailing edge of the sheet of paper being imprinted. At that time, platen controls 63 cause platen 60 to rotate in a forward direction one quarter of a revolution to bring the now-imprinted sheet out from under platen feed guide 66. Platen controls 63 then cause platen 60 to reverse direction to rotate backwards a predetermined number of times so as to eject the printed piece of paper in a downward direction. Printed sheet rollers 64 aid in the ejection, bearing against the printed sheet and platen 60. Printed sheet deflection guide 65 guides the sheet in its downward path to the lower hopper (not shown). The amount of backwards platen rotation is chosen to allow the entire length of a piece of paper having predetermined maximum length to pass between platen rollers 64 and platen 60.

As platen 60 is rotating backwards to eject the printed piece of paper, drive train 35 is transferring the backwards platen rotation to the drive shaft 22 and rollers 20 so as to cause the next unprinted sheet of paper to be dispensed from feeder 10 onto paper-loading guide 56. The operation of drive train 35 is identical to its operation described in causing paper feed during printer initiation, i.e., backward, paper-ejecting rotation of platen 60 and shaft 61 causes counter-clockwise, paper-dispensing rotation of drive shaft 22 and rollers 20.

The newly dispensed sheet of paper is fed onto printer paper-loading guide 56, to deliver sheets of paper to the paper loading position of the printer when the platen has completed the predetermined number of backward, paper-ejecting rotations. An insubstantial amount of buckle may appear in the newly dispensed sheet while it lies on guide 56.

After ejection is completed and sensor 58 senses the newly-dispensed sheet of paper on paper-locking guide 56, platen controls 63 cause platen 60 to begin the paper loading and imprinting sequence described above. If, for some reason, a newly-dispensed sheet of paper is not sensed by sensor 58, i.e., paper cartridge 12 was empty, platen controls 63 cause printer 50 to stop.

Various modifications of the invention within the spirit of the invention and scope of the appended claims will be apparent to those skilled in the printing apparatus art.

What is claimed is:

1. A printer comprising a platen, path means for guiding a printed sheet downwardly out of the printer by backward rotation of said platen, a paper holder for holding sheets of unprinted paper, a drive roller disposed to contact sheets of paper in said holder and by rotation to advance sheets of paper from said holder to a loading position, a drive train connecting said platen and said drive roller mechanically connected to rotate said drive roller in a direction to advance a sheet from said holder toward said loading position while said platen rotates in a backward direction and to rotate said drive roller not at all while said platen rotates in a forward direction, control means for controlling the rotation of said platen, a paper sensor for sensing paper at said loading position and sending a signal indicative thereof to said control means, said control means being responsive to a signal from said sensor indicating a trailing edge of a sheet of paper at said loading position to cause said platen to rotate a first predetermined amount forward and then a second predetermined amount backward, being responsive to completion of sheet ejection together with a signal from said sensor indicating paper presence at said loading position to cause said platen to rotate a third predetermined amount forward, and further being responsive to a signal indicating completion of sheet ejection together with a signal form said sensor indicating paper absence to stop printer activity, and wherein said second predetermined amount is sufficient to both fully eject a sheet from the printer and to advance a sheet of paper from said paper holder to said loading position.

2. A printer as claimed in claim 1, wherein said control means is responsive to a start signal together with a signal from said sensor indicating paper absence at said loading position to cause said platen to rotate a predetermined amount in the backward direction, then if a signal of paper presence is received from said sensor, to cause the platen to rotate said third predetermined amount forward.

* * * * *